US007213545B2

(12) United States Patent
Göransson et al.

(10) Patent No.: US 7,213,545 B2
(45) Date of Patent: May 8, 2007

(54) RECIPROCATING ENGINE

(75) Inventors: Hans Göransson, Södertälje (SE); Hans Drangel, Stockholm (SE)

(73) Assignee: Saab Automobile AB (SE)

( * ) Notice: Subject to any disclaimer, the term of this patent is extended or adjusted under 35 U.S.C. 154(b) by 0 days.

(21) Appl. No.: 11/067,634

(22) Filed: Feb. 24, 2005

(65) Prior Publication Data

US 2005/0183680 A1 Aug. 25, 2005

(30) Foreign Application Priority Data

Feb. 24, 2004 (SE) ..... 0400423

(51) Int. Cl.
*F02B 75/22* (2006.01)

(52) U.S. Cl. ..... 123/78 F; 123/48 B

(58) Field of Classification Search ..... 123/195 R, 123/195 H, 78 F, 48 B, 197.4
See application file for complete search history.

(56) References Cited

U.S. PATENT DOCUMENTS 6,443,106 B1 * 9/2002 Pischinger et al. ..... 123/48 B

FOREIGN PATENT DOCUMENTS

FR 2825756 A1 * 12/2002

* cited by examiner

*Primary Examiner*—Stephen K. Cronin
*Assistant Examiner*—Hyder Ali
(74) *Attorney, Agent, or Firm*—Ostrolenk, Faber, Gerb & Soffen, LLP

(57) ABSTRACT

The invention relates to a reciprocating engine in a motor vehicle, comprising a coupling arrangement for transmission of a torque, from a crank shaft end, to a crank shaft flange supported in a cylinder block, the crank shaft end being movable in the radial direction with respect to the crank shaft flange, characterised in that the crank shaft end and the crank shaft flange together form an axially extended cavity adapted to contain the coupling arrangement.

8 Claims, 1 Drawing Sheet

RECIPROCATING ENGINE

TECHNICAL FIELD

The present invention relates to a reciprocating engine in accordance with the preamble of claim 1.

BACKGROUND

Conventional reciprocating engines usually operate at a constant compression ratio, i.e. the ratio between the maximum and the minimum volume above the piston. The higher compression ratio, the better efficiency and thereby a lower fuel consumption. However, a too high compression ratio can result in that the engine is subjected to "knocking". The risk of "knocking" is greater at high engine power, for example high engine load, speed, and acceleration. Consequently, the compression ratio is set as high as possible, but yet as low as to avoid "knocking".

This implies, that when the engine power is low, i.e. during more normal conditions of operation, the compression ratio could in reality be higher without any risk of "knocking". Thus, a reciprocating engine having a constant compression ratio does not work at an optimum during all conditions of operation.

For this reason, it is known that, during operation, to change the compression ratio of a reciprocating engine (VCR, Variable Compression Ratio) in dependence of load, speed and acceleration conditions, so that the engine can be more efficiently used.

One way of changing the compression ratio in a reciprocating engine is to support the crankshaft in eccentrics in the cylinder block, whereby by revolving the eccentrics it is possible to control the distance between the crank shaft and the cylinder head, and thus change the combustion volume at the same time as the cylinder stroke is maintained. In a conventional engine, the flywheel, coupling and transmission are usually mounted directly onto the engine. With an eccentrically supported crank shaft, problems can arise when the force is transmitted from the crank shaft to the flywheel, since the position of the crank shaft in the radial direction is not constant over time.

For this reason, different types of couplings have been developed to allow for the force transmission from the crank shaft to flywheel/coupling/transmission.

RELATED ART

U.S. Pat. No. 6,443,106 discloses an eccentrically supported crank shaft. As depicted in FIG. 1, the crank shaft 1 can transmit a torque to a, in the radial direction displaced, shaft 15 for the transmission to the flywheel/coupling/transmission. To this end, a coupling arrangement (see FIGS. 2–3) is used having two axially separated coupling halves 17, 18. These are each mounted on one of these shafts and adapted to cooperate via the elements 19. However, this coupling results in a, in axial direction, more space requiring engine, since this type of coupling arrangement is not necessary in a conventional engine having a constant compression ratio. This is not desirable since the available space in the engine house of a motor vehicle is limited. Moreover, this implies that if a motor vehicle is adapted to accept different engine types, for example a first type having a variable compression ratio, and a second type having a constant compression ratio, it can make common attachments for fly-wheel/coupling/transmission more difficult, which will make the motor vehicle more expensive as a whole.

FR 2 825 756 discloses an eccentrically supported crank shaft, which position can be changed so as to vary the compression ratio of the combustion engine. The crankshaft can transmit a torque to a flywheel 43 on which is mounted a crank shaft flange 48, which in turn is splined coupled to a shaft 44 (see FIG. 6). To this end, a coupling arrangement having coupling elements 50–53, which mutually can slide in radial directions at the same time as the force transmission is secured (see FIGS. 7–8), is used. However, large losses by friction arise during operation due to sliding between the sliding surfaces of the coupling elements. This negatively effects the total efficiency of the engine, and thereby also the fuel consumption. Moreover, the flywheel is specially adapted for this type of engine having a variable compression ratio and thus not optimised to be used in a reciprocating engine with a constant compression ratio.

For both U.S. Pat. No. 6,443,106 and FR 2 825 756, the specially adapted flywheels imply that a conventional automatic gear box can not be installed in the vehicle.

OBJECT OF THE INVENTION

An object of the invention is to provide a reciprocating engine having a variable compression ratio and having a compact design.

Yet an object of the invention is to provide a reciprocating engine with a variable compression ratio, and which in relation to a reciprocating engine having a constant compression ratio have the same external geometry.

SUMMARY OF THE INVENTION

These and other objects of the invention are achieved by means of a reciprocating engine having the features of claim 1. Since the crank shaft end and the crank shaft flange together form an axially extended cavity adapted to contain the coupling arrangement, this coupling arrangement will not affect the external geometry of the reciprocating engine, since it will be contained in the cavity. This also imply that neither the position of the crank shaft flange will be affected, nor the positions of the flywheel, coupling and transmission in the engine house, which in conventional engines are mounted directly to the crank shaft flange. In this way, their attachments, supports etc. of this type of coupling arrangements will not be affected, which is advantageous if a motor vehicle should be able to accept different types of engines.

Hereby is achieved that the adaptation to manual/automatic transmissions with a common interface is facilitated, but also that the idée as such can be realised in existing production environments without any greater modifications.

Preferably, the cavity formed by the crank shaft end and the crank shaft flange is cylindrical, and suitably the cavity comprises a first cavity portion arranged in the crank shaft flange, and a second cavity portion arranged in the crank shaft end. Hereby is achieved that these cavity portions can be adapted after the shape and the size of the coupling arrangement.

Suitably, the coupling arrangement comprises a first half attached to the first cavity portion, and a second half attached to the second cavity portion, wherein both halves are interconnected for transmission of a torque, and preferably the first and the second halves are movably arranged in the respective cavity portion in the radial direction of the cavity. Hereby is achieved that each half can compensate for the change of positions of the crank shaft when adjusting the compression ratio, with maintained ability to transmit torque.

Advantageously, the first and the second halves are axially movable in relation to each other. Hereby is achieved a good joint for the torque transmittance at the same time as the axially movability is secured.

Preferably, the coupling arrangement is arranged in the reciprocating engine for transmission of a torque to a flywheel and/or for the operation of one or several cam shafts. Hereby is achieved that the coupling arrangement can be used for transmission of forces in several applications.

SHORT DESCRIPTION OF DRAWINGS

The invention will now be described with reference to accompanying drawings, on which:

DESCRIPTION OF A PREFERRED EMBODIMENT OF A COUPLING ARRANGEMENT

Figure 1:
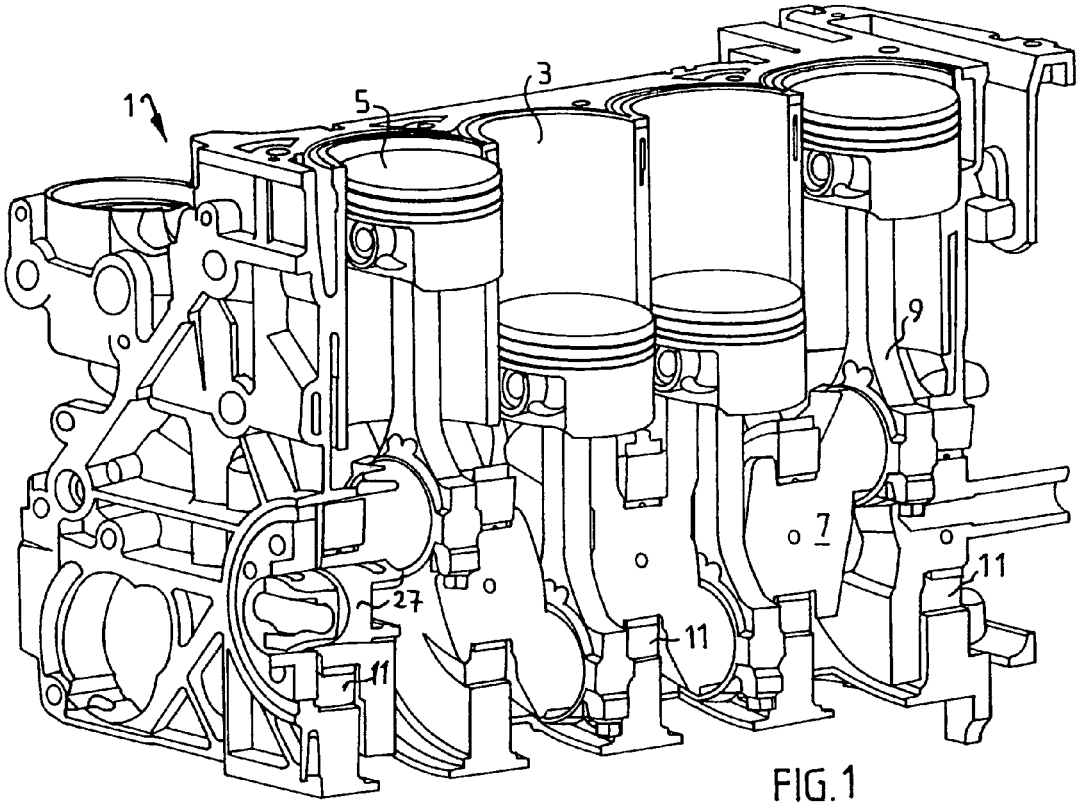
FIG. 1 shows a perspective view in cross-section of a reciprocating engine according to the invention.

FIG. 1 shows in cross-section a combustion engine 1 of reciprocating type intended for a motor vehicle. The combustion engine has four cylinders 3 with associated pistons 5. These are in a conventional manner interconnected via a common crank shaft 7 by means of connecting rods 9. The crank shaft 7 is supported by a plurality of eccentric crankshaft bearings 11 arranged in the cylinder block of the combustion engine, which allow for rotation of the crank shaft 7 in the cylinder block. The force that is generated in the cylinders 3 is transmitted, via the connecting rods 9, to the crank shaft 7, and is forwarded to a not shown coupling/transmission for the operation of the wheels of the motor vehicle, but possibly also to a cam shaft for opening/closing of the valves of the reciprocating engine, or other devices that may take advantage of the energy produced by the reciprocating engine.

With eccentric crank shaft bearings 11 is meant eccentric supporting of the crank shaft and implies that the centre axis of the crank shaft do not coincide with the centre axis that connects the different crank shaft bearings. Since the crank shaft bearings also are pivotally arranged in the cylinder block, it will be possible to change the position of the crank shaft 7 in the radial direction, and primarily in the vertical direction, i.e. the distance between the crank shaft and the cylinder head. Thus, the volume of the combustion space can be changed at the same time as the cylinder stroke is maintained, which thus affects the compression ratio of the reciprocating engine 1. The pivoting of each crank shaft bearing 11 is performed by means of a not shown device, but it is well known to the skilled man to use different types of devices to perform this type of pivoting, see for example FR 2 825 756. By varying the position of the crank shaft 7 in this way, the performance of the engine is improved since the compression ratio can be optimised as function of the operation conditions.

Figure 2:
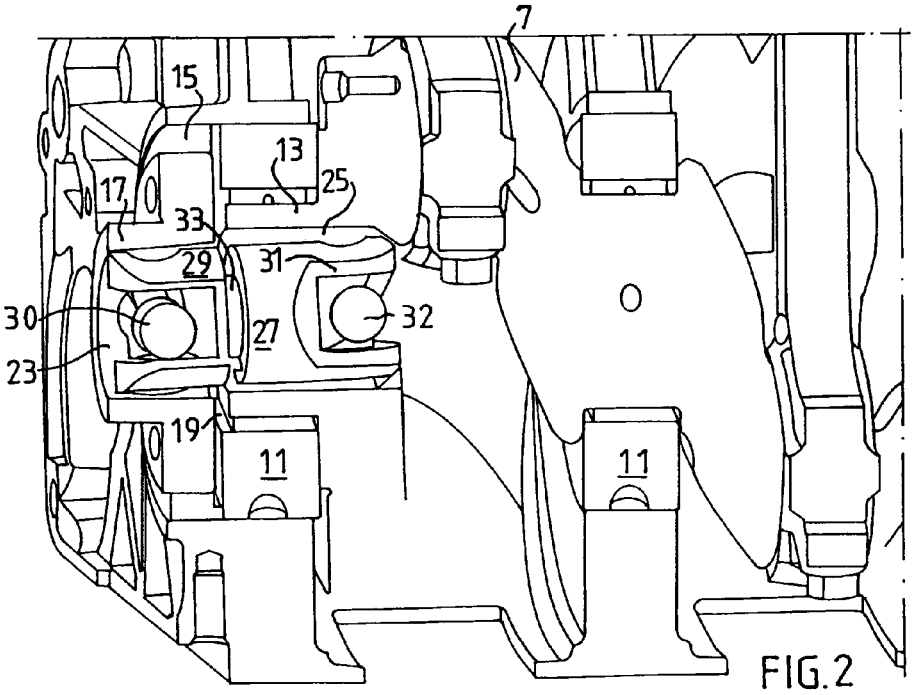
FIG. 2 shows an enlarged view of a preferred embodiment of a coupling arrangement.

FIG. 2 shows an enlargement of the reciprocating engine in FIG. 1, with focus on the left part of the reciprocating engine shown in FIG. 1. A crank shaft end 13 is supported in one of the eccentric crank shaft bearings 11 and comprises a cylindrical part 13 that forms an axially extended corbelling of the crank shaft end. In this case, the cylindrical part forms part of a crank elbow. In a bearing 15 in the cylinder block, a circular crank shaft flange 17 is also rotatably arranged, wherein the flange 17 can rotate with respect to the cylinder block. Unlike the crank shaft 7, the flange 17 is not eccentrically supported in the cylinder block. Consequently, the position of the flange 17 in the radial direction will be constant, and thereby also its distance to the cylinder head. This is important since the flywheel/coupling/transmission should be able to be coupled to the rotatable flange 17. Thereby, the crank shaft end 13 will be movable in the radial direction in relation to the flange 17. This occurs when the eccentric crank shaft bearings 11 are pivoted, when adjusting the compression ratio as desired, in dependence of the actual operation condition.

The crank shaft flange 17 and the crank shaft end 13 are arranged adjacent to each other, as seen in axial direction, with their respective centre axis positioned in planes that are parallel to each other. The crank shaft flange 17 is positioned "down stream" the crank shaft end 13, as seen in the force transmission direction. The flange 17 and the crank shaft end 13 together form, when they are arranged adjacent to each other as depicted in FIG. 2, one in an axial direction extended cavity 19 having a cylindrical surface. This cavity 19 is comprised of a first cavity portion 23 arranged in the flange 17 and a second cavity portion 25 arranged in the crank shaft end 13. As disclosed in FIG. 2, the second cavity portion 25 extends through the whole of the cylindrical corbelling and further into the crank elbow of the crank shaft.

A coupling arrangement is required to transmit a torque from the crank shaft to the crank shaft flange for transmittance to the transmission of the motor vehicle. It is also required that the torque can be transmitted between the crank shaft and the crank shaft flange even though their centre axes are situated in different planes.

To this end, several types of coupling arrangements are conceivable of which a preferred one will be described.

A coupling arrangement 27 according to the invention comprises two coupling halves 29, 31 which are mutually connected by means of an element 33 in the shape of a splined coupling 33. The first coupling half 29 comprises a part 30 consisting of four pins which together form a cross. The cross shaped part 30 is by means of two of its pins connected to the coupling half 29, which is substantially fork shaped, while the remaining two pins are connected to the cylindrical inner surface of the cavity portion 23 of the crank shaft flange 17. Each pin is moreover pivotally supported (by means of not shown needle bearings) in the coupling half 29 and in the crank shaft flange 17, respectively. Consequently, the coupling half 29 will be tiltable in an arbitrary radial direction in respect of crank shaft flange 17. In a corresponding way, the second coupling half 31 comprises a part 32 consisting of four pins which together forms a cross. The cross-shaped part 32 is by means of two of its pins connected to the coupling half 31, which is substantially fork shaped, while the other two pins are connected to the cylindrical inner surface of the cavity portion 25 of the crank shaft end. Each pin is moreover pivotally supported (by means of not shown needle bearings) in the coupling half 31 and in the crank shaft end 13, respectively. Consequently, the coupling half 31 will be tiltable in an arbitrary radial direction in respect of crank shaft flange 17.

The coupling halves 29, 31 are mutually connected by means of the splined coupling 33, which ensures that a torque can be transmitted between the coupling halves 29, 31, but also ensures that a certain axial movement of the respective coupling half is allowed during the load of the crank shaft. Due to this arrangement, when adjusting the position of the crank shaft 7 in the radial direction, the coupling arrangement 27, with its tiltable coupling halves

29, 31, will adjust to and ensure a force transmission independent of the mutual positions of the crank shaft end 13 and the crank shaft flange 17. At the same time, the external dimensions of the engine are not affected since the coupling arrangement is disposed in the cavity 19.

Instead of the above described cardan joint type of coupling arrangement, other joints can be used and the invention is not restricted to the above described embodiment. For example, so called constant velocity joints (cv-joints) are conceivable, instead of the above described coupling. The advantage of a cv-joint is that it can transmit a torque at a constant angle speed.

The invention claimed is:

1. Reciprocating engine in a motor vehicle, comprising a coupling arrangement for transmission of a torque, from a crank shaft end, to a crank shaft flange supported in a cylinder block, the crank shaft end being movable in the radial direction with respect to the crank shaft flange, characterised in that the crank shaft end and the crank shaft flange together form an axially extended cavity adapted to contain the coupling arrangement, the axially extended cavity being arranged in at least the crank shaft end.

2. Reciprocating engine according to claim 1, wherein the cavity formed by the crank shaft end and the crank shaft flange is cylindrical.

3. Reciprocating engine according to claim 1, wherein the cavity comprises a first cavity portion arranged in the crank shaft flange, and a second cavity portion arranged in the crank shaft end.

4. Reciprocating engine according to claim 3, wherein the coupling arrangement comprises a first half attached to the first cavity portion, and a second half attached to the second cavity portion, wherein both halves are interconnected for transmission of a torque.

5. Reciprocating engine according to claim 4, wherein the first and the second halves are movably arranged in the respective cavity portion in the radial direction of the cavity.

6. Reciprocating engine according to claim 4, wherein the first and the second halves are axially moveable in relation to each other.

7. Reciprocating engine according to claim 6, wherein the first and the second halves are interconnected by means of a splined coupling.

8. Reciprocating engine according to claim 1, wherein the coupling arrangement is arranged in the reciprocating engine for transmission of a torque to at least one of a flywheel and for the operation of one or several cam shafts.

* * * * *